United States Patent [19]

Larsson et al.

[11] 4,004,398

[45] Jan. 25, 1977

[54] EQUIPMENT FOR PACKAGING PULVERIZED MATERIAL

[75] Inventors: Lars Goran Larsson; Sture Ingemar Sundberg, both of Malmo, Sweden

[73] Assignee: Aktiebolaget Platmanufaktur, Malmo, Sweden

[22] Filed: Oct. 17, 1974

[21] Appl. No.: 515,661

[30] Foreign Application Priority Data

Nov. 15, 1973 Sweden ..... 7315471

[52] U.S. Cl. ..... 53/112 A; 53/124 B; 53/180 M; 426/410

[51] Int. Cl.[2] ..... B65B 31/04; B65B 1/24; B65B 9/12

[58] Field of Search ..... 53/180, 112 A, 124 B

[56] References Cited

UNITED STATES PATENTS

| | | | |
|---|---|---|---|
| 2,113,636 | 4/1938 | Vogt | 53/180 X |
| 2,145,941 | 2/1939 | Maxfield | 53/180 X |
| 3,318,067 | 5/1967 | Grafingholt | 53/180 X |
| 3,702,147 | 11/1972 | Slawinski | 53/124 B X |
| 3,721,060 | 3/1973 | Quinto | 53/124 B |

*Primary Examiner*—Travis S. McGehee

*Attorney, Agent, or Firm*—Hane, Baxley & Spiecens

[57] ABSTRACT

A firm container is fed with a plastic material which surrounds the firm container along a portion of its length. The firm container has an open end which is closed off by a pair of welding jaws which welds the plastic material together and forms the bottom of a container that holds a pulverized material. Pulverized material is then fed to the bottom of the container and after feeding is over, the plastic material is allowed to fall from the firm container by moving a support table downwardly. After the support table has moved downwardly a certain distance, the welding jaws are operated again and weld a new piece of plastic material to the open end of the firm container, thus forming a bottom for a new container and closing off the top of the previously-made container. A piston is provided within the firm container for compressing the pulverized material fed into the interior of the firm container. Pressurized gas is also fed to the interior of the firm container to assure proper distribution of the pulverized material in the container.

13 Claims, 7 Drawing Figures

EQUIPMENT FOR PACKAGING PULVERIZED MATERIAL

BACKGROUND OF THE INVENTION

The present invention relates to a method of packing pulverized material such as coffee in a container made of foil or film material, for instance plastic laminate.

It is known to pack pulverized material such as coffee in containers made of film material, and the pulverized material then occupies about two thirds of the volume available. The reason why the container is not filled completely is that the wall of the container becomes electrostatically charged and grains of the pulverized material can adhere to the film at the place where it is sealed. It is therefore necessary to have a certain distance between the pulverized material and the sealing point. It is also known to pack pulverized material in containers of the nature of a film under compression. At the compression, however, the walls are subjected to severe mechanical stresses, and it is therefore necessary to use comparatively thick film material, which makes the wrapping more expensive. Finally, it is also known to pack pulverized material in containers made of film under vacuumizing. However, it is a certain drawback to have an outer air pressure on the wrapping, as the oxygen in the air can penetrate into the wrapping in micro-cracks and pores which are formed to a certain extent. These problems are accentuated at hard vacuumizing, particularly at the packing of products which have hard, sharp grains, such as ground coffee.

SUMMARY OF THE INVENTION

The purpose of the present invention is to eliminate the above-mentioned drawbacks, by creating a method according to which pulverized material is compressed in a container which is firm, and the bottom of which consists of the bottom of the final container, which container is made of flexible material and the other parts of which surround said firm container. The surrounding parts have the nature of a jacket or a tube. When the compression has been completed, said bottom is lowered, and the flexible container is closed, at the same time as a new bottom is formed for the firm container.

According to the method, the firm container can also be subjected to vibration. The method according to the invention also utilizes a supporting bottom outside of the bottom made of flexible film. Said supporting bottom can consist of two or more welding jaws, which simultaneously or in separate operations can close a filled container made of flexible material and form a new bottom of flexible material for the firm container. The welding jaws can also separate the filled container made of flexible material from the newly formed bottom made of flexible material for the firm container.

During the procedure for filling a flexible container with pulverized material, evacuation as well as injection of inert gas can take place. The supply of gas and the evacuation is particularly balanced so that unnecessary contact with the container walls of flexible material by the pulverized material is prevented during the sealing operation and, furthermore, at the final sealing, the container walls of film material snuggle up closely to the product body that has been formed.

The evacuation and supply of gas should appropritely take place via the firm container.

Equipment according to the present invention can consist of, for instance, a tubular container on which a tubular film of elastic material such as plastic is applied. The tubular container coacts with a feeding device for feeding down the tubular film and with closing means, for instance welding jaws for closing said tube below the lower end of the firm container and with a piston in said firm container for compression of pulverized material conveyed into said container.

The equipment according to the invention can be provided with a supporting bottom that can be applied or removed for the closing of film material for the firm container. According to one embodiment in the equipment, said supporting bottom can consist of welding jaws for sealing of the film.

The sealing members in the equipment have such properties that, at the sealing, a filled container made of film will be closed at the same time as a new film bottom is formed for the firm container, said closed container made of flexible material then being separated from the newly formed bottom at the sealing or in a separate operation.

The equipment according to the invention is also provided with a table that can be raised and lowered for filled containers made of film material.

The equipment according to the invention can be provided with devices for subjecting the firm container to vibrations.

According to an advantageous embodiment of the equipment, the piston is provided with a bottom that can be opened and closed, whereby a predetermined quantity of pulverized material can be supplied to the firm container, for compression and possible evacuation and/or injection of gas.

An alternative closing device for the piston compared with the one already described consists of a number of flaps, which are controlled and supported in such a way that the opening and closing movements of the flaps takes place more or less synchronously for the separate flaps and so that sealing joints are obtained for the goods which are packed, but not necessarily for gas.

In the equipment according to the invention, the piston can be provided with a portion container, which is emptied through the bottom of the container.

The equipment according to the invention can be combined with conventional evacuation and injection devices for gas, which are connected with said piston.

According to an advantageous embodiment of the equipment, hollow shafts, which control the opening and closing of the bottom of the piston can constitute connection channels for said evacuation devices and said injection devices for gas.

The equipment according to the present invention can be combined with e.g. a device which, from one or several strips of film, forms a tube which is applied continuously onto said firm container.

BRIEF DESCRIPTION OF THE DRAWING

The present invention will be described in more detail with reference to the attached six drawings, in which.

DETAILED DESCRIPTION OF THE INVENTION

Figure 5:
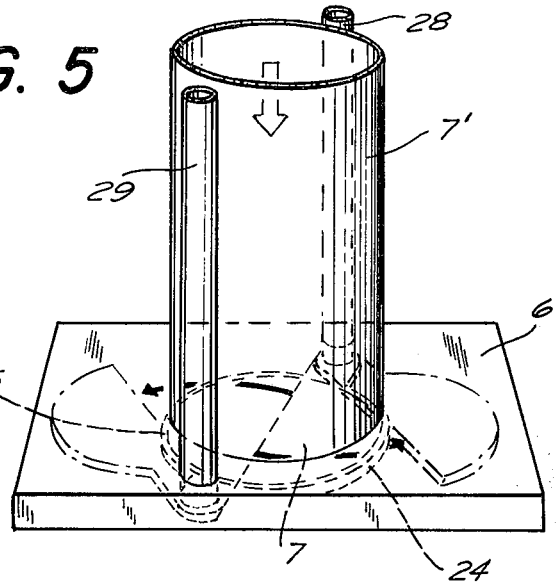
FIG. 5 shows, viewed from the side, the piston for the firm container in the equipment according to the foregoing figures.
Figure 7:
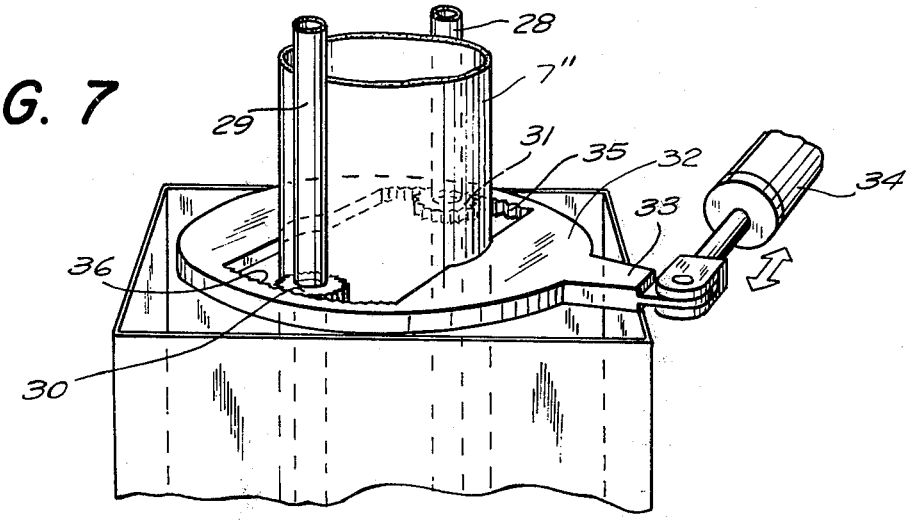
FIG. 7 shows the piston viewed from above.
Figure 6:
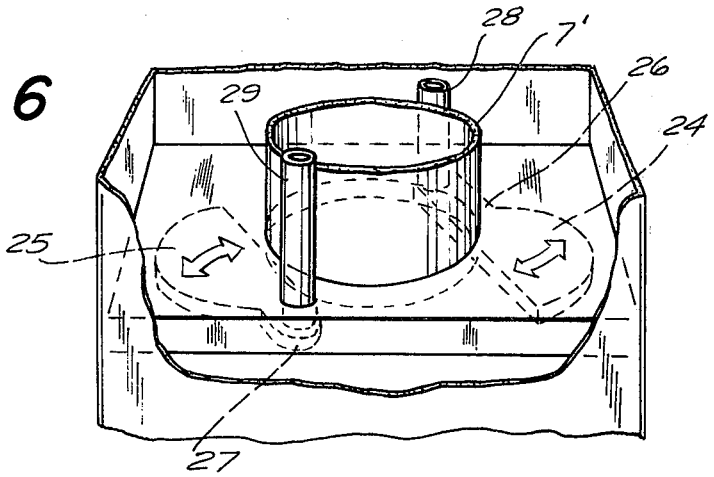
FIG. 6 shows the piston viewed from below.

In the figures, 1 designates film material of, for instance, plastic in a flat condition. This film material is applied in a normal way to a forming shoulder and is formed around this into a tube 3, according to the trans-wrap method. The tube formed is applied onto a firm container 4, and is closed below the lower end of the firm container 4 and thereby forms a film bottom 5. In the firm container 4 there is arranged a piston 6 which moves up and down and which has a bottom part 7 that can be opened and closed. Said bottom part will be described with reference to FIGS. 5, 6 and 7. The unit 8 is a device for generating gas, for instance a gas which is inert towards the material which is to be packed. The unit 8 is connected with an injection conductor 9, which emerges through the piston 6.

The unit 10 is intended to achieve vacuum, and has a connection pipe 11, which emerges in the bottom of the piston 6. It should be obvious that the injection conductor 9 and the evacuation pipe 11 can go through the bottom of the piston 6, and can possibly be provided with nozzles that can be opened and closed at their ends. Likewise, their positions can be variable in relation to the piston.

Above the bottom part 7 a container 7′ is arranged. The firm container 4 is intended to be filled with pulverized material, such as coffee. Under the film bottom 5 two welding jaws 13 and 14 are arranged, which are movable in a horizontal plane. These welding jaws are arranged in such a way that they form either two horizontal welds located one over the other, the upper one then being comprised in the bottom 5 and the lower one forming the closure of the filled container 19, or one single weld which is divided horizontally in about the middle with the aid of a cutting tool, if any, which can be contained in said welding jaws. When there are two welds, the cutting tool can cut off the tubular film between the two welds.

If the firm container 4 has a cross section with straight sides, for instance square or rectangular, flaps will be formed. With the aid of the welding jaws 15 and 16, and 17 and 18, which are movable vertically, welds are achieved at the wall of the wrapping at the flaps that have been formed, in order to fix the form of the filled wrapping. Under the filled container 19 a table 20 is arranged, which can be raised and lowered with the aid of a lifting mechanism 21

At the outer envelope surface of the firm container two film feeding devices 22 and 23 are arranged, for feeding tubular film down towards the bottom of the firm container. There can be more than two of these feeding devices, and they can be of any known kind whatsoever.

The piston 6 is provided at its bottom with two semicircular plates 24 and 25, each of which is provided with a fastening lug 26 and 27. Said fastening lugs 26 and 27 are fastened each in its hollow shaft 28 and 29. The upper ends of the shafts 28 and 29 are each provided with a gear wheel 30 and 31. The gear wheels coact with a plate 32, which has an arm 33 which, in turn, is connected with a hydraulic piston 34. Said coaction takes place in such a way that the plate 32 has two fixed gear segments 35 and 36 with which the gear wheels 31 and 30 coact. The equipment described above functions in the following way.

Figure 1:
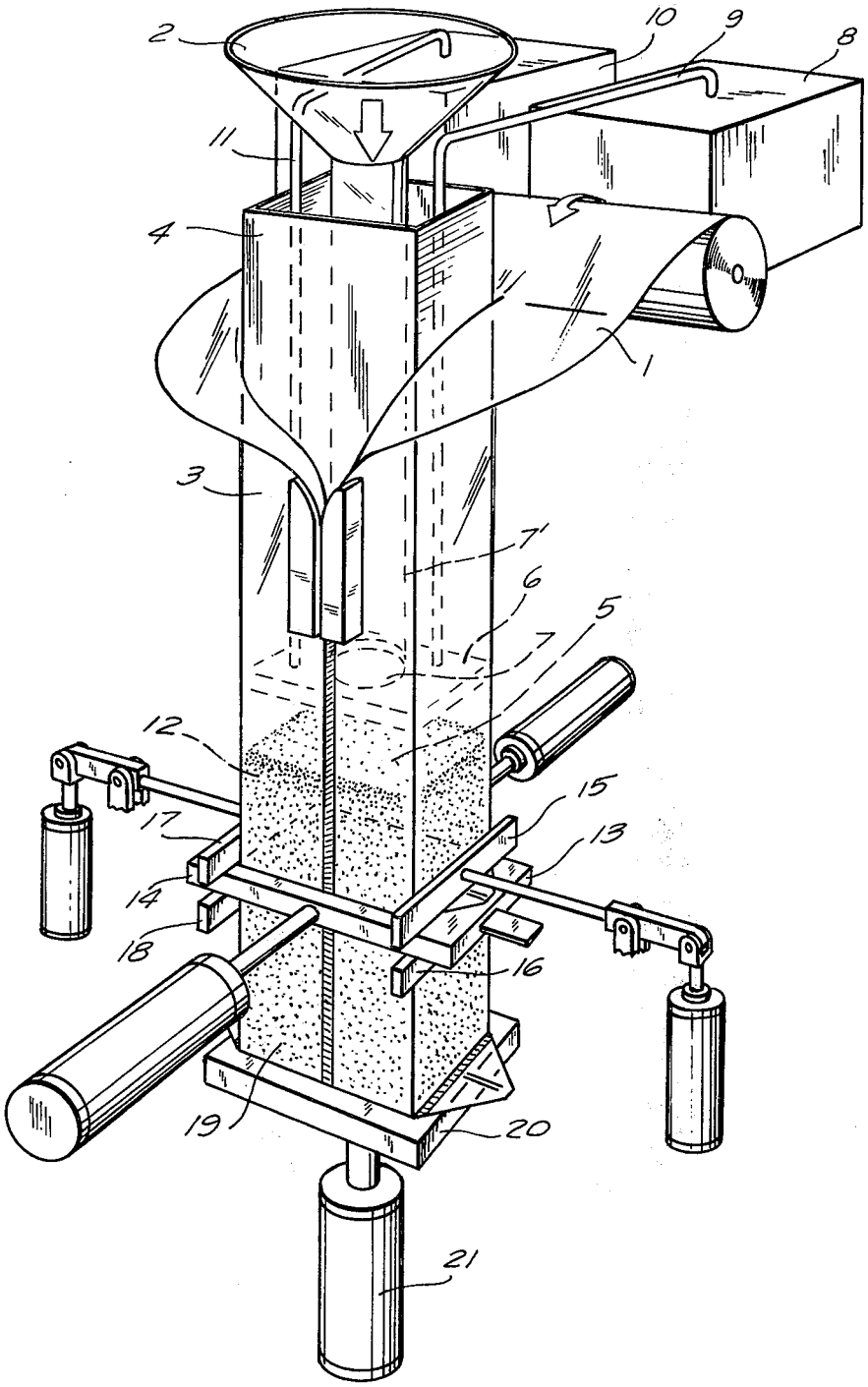
FIG. 1 shows complete equipment for filling pulverized material into a container made of tubular film of elastic material such as plastic, where the pulverized material is conveyed to a firm container.
Figure 2:
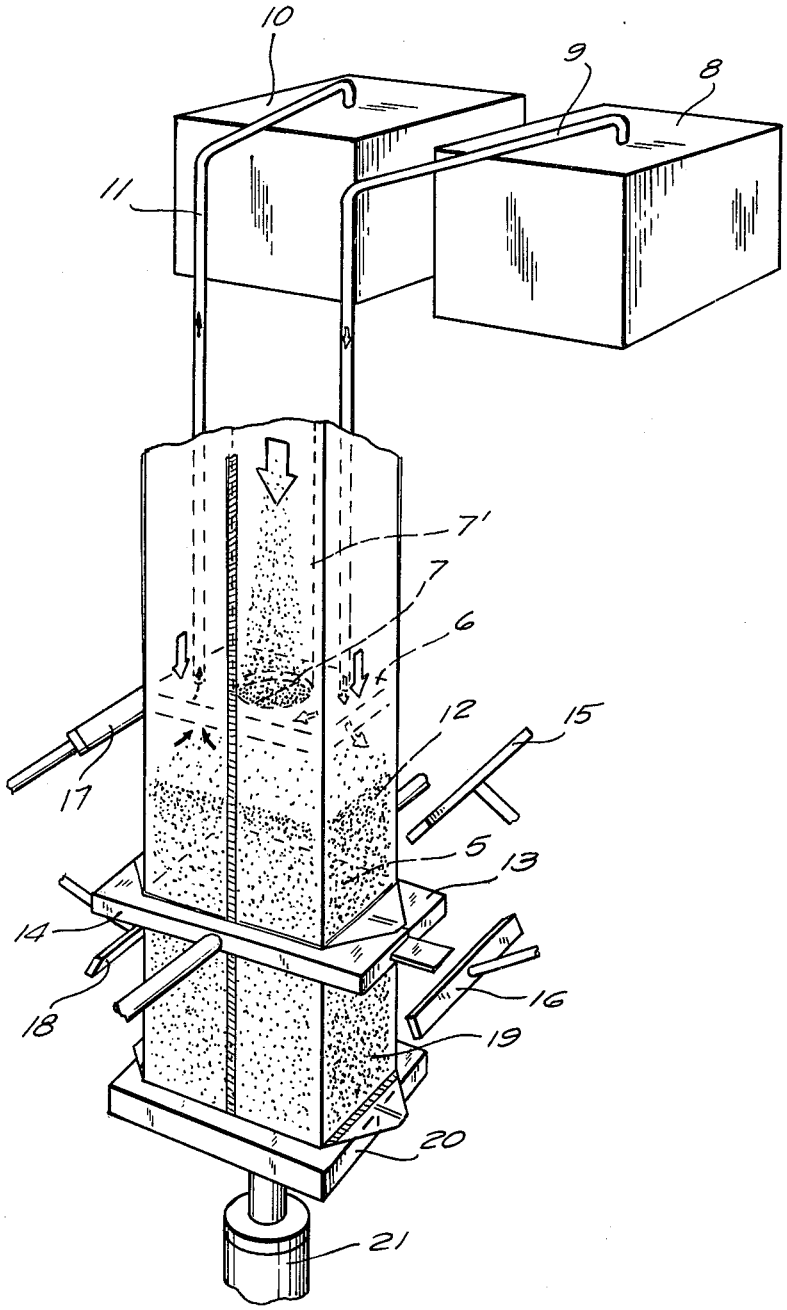
FIG. 2 shows the same equipment as in FIG. 1, where the pulverized material is compressed in the firm container.
Figure 3:
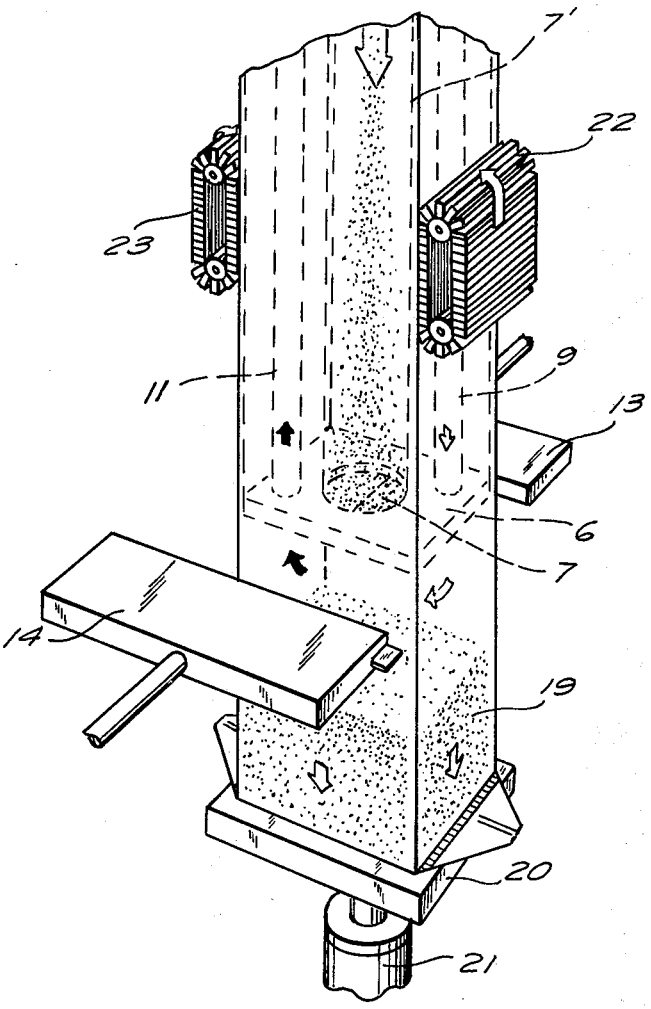
FIG. 3 shows the same equipment, where compressed pulverized material is transferred to a tubular container made of film.
Figure 4:
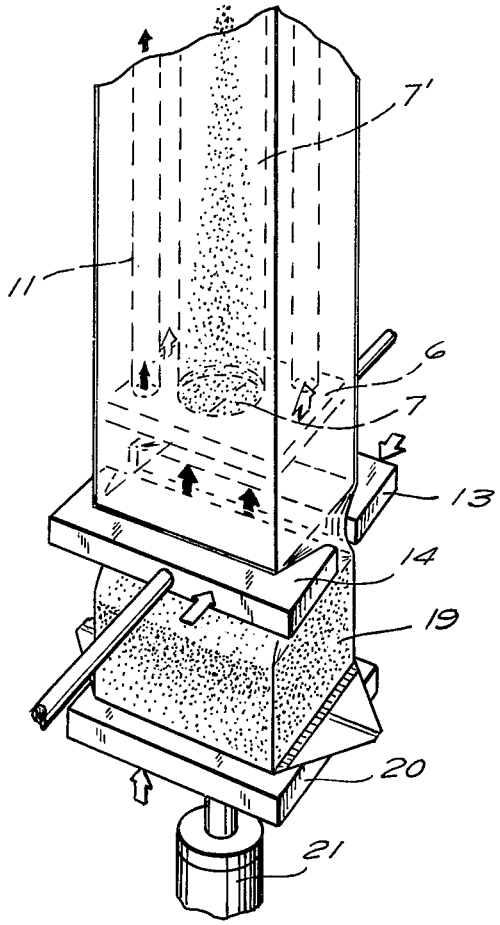
FIG. 4 shows the same equipment during the sealing of a filled tubular container made of film, at the same time as the bottom of a new container made of film is being formed.

Tubular film material is fed down over the firm container 4 with the aid of the feeding mechanisms 22 and 23. When a sufficient quantity of tubular material has passed the lower end of the firm container, the end of the tube is closed with the aid of the welding jaws 13 and 14. When the welding jaws have performed their function, they remain in the position shown in FIG. 1. The firm container thus obtains a bottom made of film material, at the same time as said bottom obtains a supporting bottom, provided by the welding jaws 13 and 14. The film bottom of the firm container 4 will also become the bottom of the forthcoming container made of film material, which is to be filled with pulverized material. Under the piston 6 there is thus a space which is ready to receive pulverized material 12. It is assumed that the bottom of the piston 6 has been closed by the semicircular plates 24 and 25. In this situation a predetermined quantity of pulverized material is fed to the funnel 2. The pulverized material goes into the container 7′. If the plates 24 and 25, with the aid of the hydraulic piston 34 are caused to assume the positions shown by the dot-dash lines in FIG. 5, the bottom of the piston is opened, after which the predetermined quantity of pulverized material goes into the firm container 4 and will be in contact with the film bottom 5. The two semicircular plates 24 and 25 are again caused to move into the positions shown by the broken lines in FIG. 5 with the aid of the hydraulic piston 34. The piston 6 can now be moved downwards, and compress the pulverized material into the body desired, with evacuation and injection of gas, if desired. At the compression, the film which is to surround the body of pulverized material is not subjected to any undesirable stresses. The evacuation and injection of gas takes place via the hollow shafts 28 and 29. When the compression has been completed the welding jaws 13 and 14 are moved away, and the tubular film is lowered to the position shown in FIG. 3, and the open container 19 is then resting on the table 20. The lowering is adapted exactly so that sufficient tubular material is available for the closing of the container 19 and for forming a new bottom 5 for the next container. When the lowering has been completed, the welding jaws 13 and 14 are moved into the welding position, at the same time as the container 19 is raised through the table 20. The gas pressure between filled pulverized material and the bottom of the piston is balanced so that the plastic film easily follows the movement of the welding jaws 13 and 14 to welding. When the welding jaws approach the welding position, the container 19 is subjected to vacuum, so that the film in the container will fit tightly around the body of pulverized material which has been formed. When the weld has been completed, the next container can be filled etc. During the packing procedure, the function of the gas which has been injected is to prevent a change of the finally formed body of pulverized material, and to co-operate towards the snuggling up and smoothing out of the film material against the finally formed body of pulverized material. In order to achieve the vacuum desired without reducing the packing speed, at a second station e.g. a flap of the container can be opened, high vacuumizing can be carried out, and the opening recently made can be closed.

The purpose of the previously mentioned welding jaws 15 and 16, and 17 and 18, is to achieve welding of the flaps of film material at the compressed body, in order to maintain its form. All of the welding jaws can have synchronized movements up and down for feeding of filled wrappings and for pulling down new film material.

Compression and possibly vibration, as well as injection of gas and evacuation are adapted in such a way that a container made of film material will be filled under the least possible mechanical stresses on the film material, and in such a way that the container made of film material will obtain a desired and permanent geometric form, for instance a parallelepiped.

The inner container can alternatively be made by one or several films being formed around the firm container into a finished inner container, which is open in one of its ends. The inner container can also be prefabricated, and applied on the firm container.

The method and equipment described in the foregoing can also be applied to wrappings made of more firm material, such as cartons and tins. In this case the film will be omitted, and instead a tin or carton will be applied over the part 4, from below. The part 4 will thus function as a thin liner inside the tin or carton. The welding jaws are replaced by other closing members for cartons or tins. Through the use of the equipment described in the foregoing, it is possible to utilize cartons or tins of thinner material.

The present invention thus shows how pulverized material is to be compressed in various wrapping materials without subjecting the wrapping material to severe mechanical stresses, and this is achieved according to the invention by using a temporary liner made of strong material, which is used in the wrapping only during the compression.

We claim:

1. Apparatus for producing a container of pulverized material comprising a firm hollow container having an open lower end, said firm hollow container being positioned vertically, means for feeding a material which will constitute the container of pulverized material, said means feeding said material to said firm container and surrounding said firm container along at least a portion of the length thereof thereby forming a tube of said material surrounding said firm container, said portion comprising said open end, means for closing off said open end of said material constituting the container of pulverized material and supporting said closed end during the feeding of said pulverized material, a piston mounted for reciprocation within said firm container for compressing said pulverized material, said piston comprising a central opening therein, and means for closing off and opening said central opening for the passage of pulverized material therethrough toward said open end, and means for feeding said pulverized material into said firm container toward said open end, whereby the pulverized material fed to the open end of said firm container is compressed by said piston and said material constituting said container of pulverized material is formed into a container by the lowering thereof from said open end.

2. The apparatus according to claim 1, further comprising means for supporting that portion of said material constituting the container of pulverized material covering said open end of said firm container after said pulverized material has been fed, and means for vertically moving said means for supporting toward and away from said means for closing off said open end.

3. The apparatus according to claim 2, wherein said means for closing off said open end comprises a first and a second horizontally movable welding jaw which together form a support table for the portion of the material constituting the container of pulverized material covering said open end and which welds the bottom of the container of pulverized material.

4. The apparatus according to claim 3, wherein said means for closing off said open end further comprises a plurality of additional welding jaws for forming flaps in the portion of the material constituting the container of pulverized material surrounding said open end.

5. The apparatus according to claim 1, wherein said means for feeding said pulverized material into said firm container comprises a feed tube having one end shaped as a funnel for the reception of said pulverized material therein, and a second end spaced vertically from said first end and in close proximity to and in alignment with said central opening of said piston, whereby said pulverized material flows from said funnel through said feed tube and through said central opening into the interior of said firm container.

6. The apparatus according to claim 1, wherein said means for feeding said pulverized material into said firm container comprises means for actuating said means for closing off and opening said central opening of said piston.

7. The apparatus according to claim 6, wherein said means for closing off and opening said central opening comprises a first and a second pivot plate, said plates when pivoted toward each other closing off said central opening and when said plates are pivoted away from each other opening said central opening for the passage of said pulverized material therethrough.

8. The apparatus according to claim 7, wherein said means for actuating comprises a rotatable plate mounted on the top surface of said piston, said rotatable plate having a first and a second gear portion formed therein, and said means for closing off and opening said central opening of said piston further comprises a first and a second hollow pivot shaft for allowing for the pivotal movement of said first and second pivot plates, respectively, and a first and a second gear mounted on said first and second hollow pivot shafts, respectively, said first gear on said first hollow pivot shaft engaging with said first gear portion of said rotatable plate, and said second gear on said second hollow pivot shaft engaging with said second gear portion of said rotatable plate.

9. The apparatus according to claim 8, wherein said means for feeding pulverized material further comprises a feed tube having one end near and cooperating with said central opening of said piston, said rotatable plate surrounding said feed tube and having a central cut-out having said first and second gear portions formed on the circumference thereof.

10. The apparatus according to claim 9, wherein said means for feeding further comprises means for rotating said rotatable plate and therefore said first and second pivot plates, said first and second pivot plates being mounted on the bottom surface of said piston, and said first and second gears being mounted on the top surface of said piston.

11. The apparatus according to claim 8, further comprising means for supplying a pressurized gas to the interior of said firm container, and means for removing said pressurized gas therefrom, said means of supplying said pressurized gas comprising a source of pressurized gas and said first hollow pivot shaft, and said means for removing said pressurized gas comprises a source of vacuum and said second hollow pivot shaft, said pressurized gas travelling from said source of pressurized gas through said first hollow pivot shaft and exiting through said second pivot shaft in response to said source of vacuum.

12. The apparatus according to claim 1, further comprising means for supplying a pressurized gas to the interior of said firm container, and means for removing said pressurized gas therefrom.

13. Apparatus for producing a container of pulverized material comprising a firm hollow container having an open lower end, said firm hollow container being positioned vertically, means for feeding a material which will constitute the container of pulverized material, said means feeding said material to said firm container and surrounding said firm container along at least a portion of the length thereof thereby forming a tube of said material surrounding said firm container, said portion comprising said open end, means for closing off said open end of said material constituting the container of pulverized material and supporting said closed end during the feeding of said pulverized material, a piston mounted for reciprocation within said firm container for compressing said pulverized material, and means for feeding said pulverized material into said firm container toward said open end, whereby the pulverized material fed to the open end of said firm container is compressed by said piston and said material constituting said container of pulverized material is formed into a container by the lowering thereof from said open end, means for supporting that portion of said material constituting the container of pulverized material covering said open end of said firm container after said pulverized material has been fed, said means for closing off said open end comprising a first and a second horizontally movable welding jaw which together form a support table for the portion of the material constituting the container of pulverized material covering said open end and which welds the bottom of the container of pulverized material, and a plurality of additional welding jaws for forming flaps in the portion of the material constituting the container of pulverized material surrounding said open end, and means for vertically moving said means for supporting toward and away from said means for closing off said open end.

* * * * *